US006655454B1

(12) United States Patent
Floyd

(10) Patent No.: US 6,655,454 B1
(45) Date of Patent: Dec. 2, 2003

(54) CHECK ENHANCER FOR INJECTING FLUIDS INTO A WELL

(76) Inventor: Danny Joe Floyd, Rte. 1, Box 133, Thomas, OK (US) 73669

( * ) Notice: Subject to any disclaimer, the term of this patent is extended or adjusted under 35 U.S.C. 154(b) by 0 days.

(21) Appl. No.: 10/176,808

(22) Filed: Jun. 20, 2002

(51) Int. Cl.[7] ..... E21B 34/00
(52) U.S. Cl. ..... 166/80.1; 166/148; 166/185
(58) Field of Search ..... 166/270.1, 300, 166/304, 90.1, 80.1, 81.1, 75.12, 148, 151, 185, 319

(56) References Cited

U.S. PATENT DOCUMENTS

| | | | | |
|---|---|---|---|---|
| 2,562,458 A | * | 7/1951 | Hartsell | 166/177.3 |
| 3,935,903 A | | 2/1976 | Arendt | |
| 4,267,888 A | * | 5/1981 | Singer | 166/312 |
| 4,297,084 A | | 10/1981 | Wayt | |
| 4,515,608 A | | 5/1985 | Clegg | |
| 4,621,403 A | | 11/1986 | Babb et al. | |
| 4,676,308 A | | 6/1987 | Chow et al. | |
| 4,682,559 A | | 7/1987 | Schnitzer et al. | |
| 4,789,031 A | | 12/1988 | Walker | |
| 5,056,599 A | * | 10/1991 | Comeaux et al. | 166/310 |
| 5,117,913 A | | 6/1992 | Themig | |
| 5,163,515 A | | 11/1992 | Tailby et al. | |
| 5,282,263 A | * | 1/1994 | Nenniger | 392/301 |
| 5,435,395 A | | 7/1995 | Connell | |
| 5,474,127 A | | 12/1995 | White | |
| 5,704,393 A | | 1/1998 | Connell et al. | |
| 5,762,142 A | | 6/1998 | Connell et al. | |
| 5,765,643 A | | 6/1998 | Shaaban et al. | |
| 5,845,711 A | | 12/1998 | Connell et al. | |
| 5,884,701 A | | 3/1999 | Von Plahn | |
| 5,924,490 A | * | 7/1999 | Stone | 166/312 |
| 6,065,540 A | | 5/2000 | Thomeer et al. | |
| 6,082,454 A | | 7/2000 | Tubel | |
| 6,176,323 B1 | | 1/2001 | Weirich et al. | |
| 6,192,983 B1 | | 2/2001 | Neuroth et al. | |
| 6,300,762 B1 | | 10/2001 | Thomas, Jr. et al. | |

FOREIGN PATENT DOCUMENTS

| | | |
|---|---|---|
| EP | 0 892 147 A2 | 1/1999 |
| WO | WO 94/09248 | 4/1994 |

* cited by examiner

*Primary Examiner*—Frank Tsay
(74) *Attorney, Agent, or Firm*—McAfee & Taft

(57) ABSTRACT

A check enhancer for use in a well comprises an outer housing portion and an inner injector portion disposed in the housing portion. The housing portion includes an outer body defining a fluid cavity therein with a plurality of body ports in communication with the fluid cavity and an adapter which slidably receives a portion of a length of tubing therethrough. A tubing fitting connects the tubing to the adapter. The injector portion includes a check valve and a dispersement nipple attached thereto. The check valve is connected to the tubing in the fluid cavity by another tubing fitting, and the check valve allows fluid flow from the tubing through nipple ports defined in the dispersement nipple. The nipple ports are longitudinally spaced from the body ports so that the fluid cavity remains substantially filled with fluid with the dispersement nipple substantially submerged within the fluid.

27 Claims, 2 Drawing Sheets

CHECK ENHANCER FOR INJECTING FLUIDS INTO A WELL

BACKGROUND OF THE INVENTION

1. Field of the Invention

This invention relates to bottom-hole assemblies used in oil and gas wells, and more particularly, to a check enhancer having an outer body with ports longitudinally spaced from ports in a dispersement nipple of the apparatus.

2. Description of the Prior Art

It is well known in the production and treatment of oil and gas wells to inject fluids into the well. This is done in a variety of ways, one of which is to use a bottom-hole assembly. Prior art bottom-hole assemblies comprise a ball check valve attached to a ported dispersement nipple. The ball check valve is connected to a length of coiled tubing by a known tubing fitting. The coiled tubing is used to run the tool into the well to a desired location. In operation, fluid is flowed down the tubing into the bottom-hole assembly. The fluid passes through the ball check valve which allows flow downwardly therethrough and prevents any significant amount of fluid from flowing back upwardly through the tubing. The fluid flows out of the bottom-hole assembly through the ports in the dispersement nipple and into the well at a location adjacent to the bottom-hole assembly.

These prior art bottom-hole assemblies have had a couple of problems. First, scale deposits due to contaminants in the well can build up in the ports in the dispersement nipple, and this will eventually restrict the flow therethrough. If this occurs, it may be necessary to remove the assembly from the well prematurely for cleaning. This is both costly and time consuming.

Another problem with the prior art bottom-hole assembly is that bubbles may form in the dispersement nipple. These bubbles can float up within the dispersement nipple and pass upwardly through the ball check valve, either when the ball check is open to flow fluid therethrough or because a complete seal may not be formed in the valve when it is closed. These bubbles can disrupt the flow through the tubing.

The present invention solves these problems by adding an outer housing around the prior art bottom-hole assembly. The body keeps clean fluid around the check valve and dispersement nipple which significantly reduces or eliminates scale deposits in the check valve and nipple ports. Also, the presence of fluid adjacent to the dispersement nipple minimizes bubble formation. Bubbles may form at the ports in the outer housing, but even if this occurs, the bubbles will merely float up to the upper inside portion of the outer housing which is not a problem because that portion of the housing is not in communication with the tubing.

SUMMARY OF THE INVENTION

The present invention is an improved bottom-hole assembly, and more specifically, as used herein, a check enhancer apparatus for use in injecting fluids into a well. The enhancer generally comprises a housing portion defining a fluid cavity therein and a housing port in communication with the fluid cavity, a length of tubing connected to the housing portion such that a portion of the tubing extends into the fluid cavity, and an injector portion disposed in the fluid cavity and connected to the portion of the tubing in the fluid cavity. The injector portion define an injector port therein in communication with the tubing and the fluid cavity, and the injector port is longitudinally spaced from the housing port.

The housing portion comprises an outer body in which the housing port is disposed and an adapter connected to the outer body and the tubing. The adapter defines an opening through which the tubing is slidably disposed. The injector portion comprises a dispersement nipple in which the injector port is disposed and a check valve connected to the dispersement nipple and the portion of the tubing extending into the fluid cavity.

The check valve, preferably either a ball check valve or poppet-type valve, allows fluid flow from the tubing to the dispersement nipple and substantially prevents fluid flow from the dispersement nipple to the tubing. The housing port is preferably located above the injector port when the apparatus in disposed in the well, such that fluid flowing out of the injector port at least partially fills the fluid cavity before flowing out of the housing port. In one embodiment, the injector port is one of a plurality of injector ports, the housing port is one of a plurality of housing ports and all of the housing ports are longitudinally spaced from all of the injector ports.

Stated another way, the present invention is a check enhancer comprising a dispersement nipple defining a nipple port therein, a check valve connected to the dispersement nipple and adapted for connection to a length of tubing such that the nipple port is in communication with the tubing when the check valve is in an open position, and an outer body disposed around the dispersement nipple and the check valve, the outer body defining a body port therein. The body port is longitudinally spaced from the nipple port, and in the preferred embodiment, the body port is above the nipple port when the apparatus is positioned in the well. The nipple port is preferably one of a plurality of nipple ports defined in the dispersement nipple, the body port is one of a plurality of body ports defined in the outer body, and all of the body ports are longitudinally spaced from all of the nipple ports. The check valve is attached to the tubing by a tubing fitting.

The enhancer further comprises an adapter connected to the outer body and adapted for connection to the length of tubing. The tubing is slidably disposed through the adapter such that the dispersement nipple and the check valve may be longitudinally moved in the outer body. The adapter is attached to the tubing by a tubing fitting, and the check valve is attached to the tubing by another tubing fitting.

Numerous objects and advantages of the invention will become apparent as the following detailed description of the preferred embodiment is read in conjunction with the drawings which illustrate such embodiment.

DESCRIPTION OF THE PREFERRED EMBODIMENT

Figure 1:
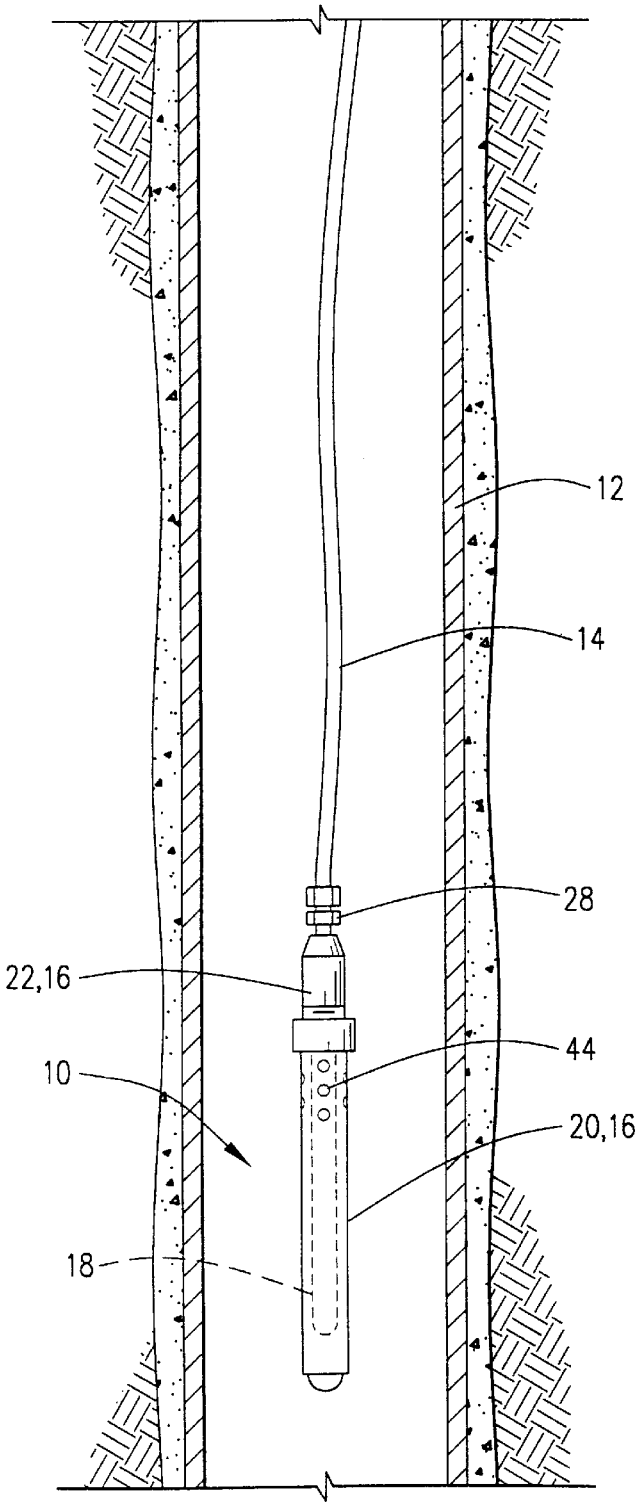
FIG. 1 shows the check enhancer of the present invention as it is run into a well on a length of coiled tubing.

Referring to FIG. 1, the check enhancer of the present invention is shown and generally designated by the numeral 10. Apparatus or enhancer 10 is shown positioned in a well 12 on a length of coiled tubing 14.

Figure 2A:
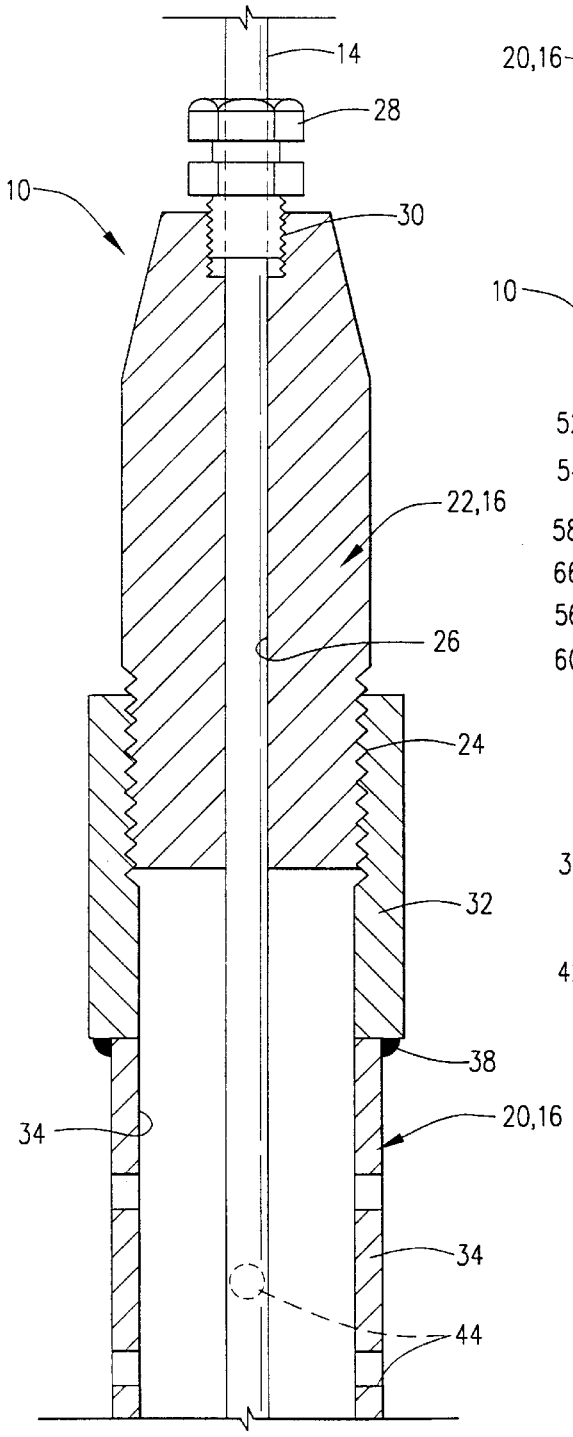
FIGS. 2A and 2B illustrate a cross-sectional view of the enhancer.
Figure 2B:
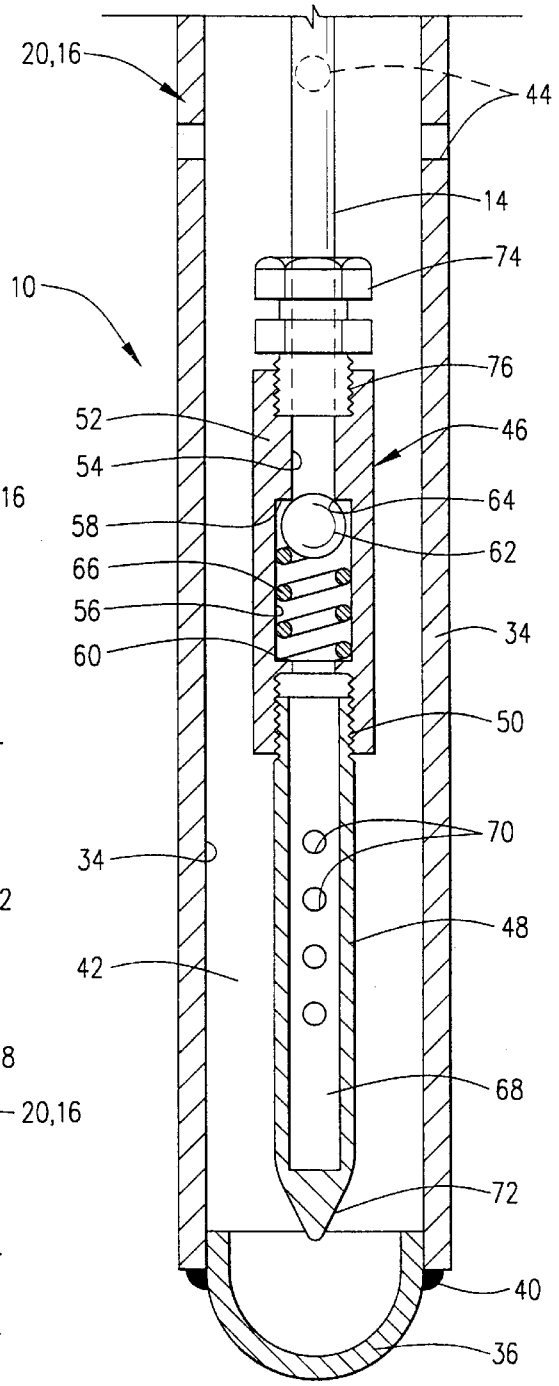

Referring now also to FIGS. 2A and 2B, details of enhancer 10 will be discussed. Generally, enhancer 10 comprises an outer housing portion 16 and an inner injector portion 18 disposed in the housing portion. Injector portion 18 is substantially the same as a prior art check enhancer which has been used in wells without any outer housing.

Housing portion 16 includes an outer body 20 and an adapter or bonnet 22 attached thereto by any means known in the art, such as threaded connection 24. Adapter 22 defines a central opening through which a portion of tubing 14 extends. Opening 26 is sized so that tubing 14 may be slidably disposed therethrough.

Adapter 22 is attached to tubing 14 by a housing tubing fitting 28. Housing tubing fitting 28 is connected to adapter 22 by any means know in the art, such as threaded connection 30. Housing tubing fitting 28 can be of any type known in the art, such as, but not limited to, a compression fitting as shown in FIG. 2A. Prior to tightening housing tubing fitting 28, tubing 14 can be moved in opening 26 in adapter 22 so that injector portion 18 may be placed in any desired position relative to housing portion 16.

In the embodiment shown in the drawings, outer body 20 comprises a collar 32, a cylinder 34 and an end cap 36. Collar 32 is fixedly attached to cylinder 34 by a means known in the art, such as a weld 38. End cap 36 is fixedly attached to cylinder 34 by a means known in the art, such as weld 40. Thus, outer body 20 is integrally formed. Alternatively, outer body 20 may be made from a single piece of material.

Outer body 20 defines a fluid cavity 42 therein and a plurality of body or housing ports 44 which provide communication between fluid cavity 42 and well 12. Body ports 44 are preferably at the upper end of fluid cavity 42.

Injector portion 18 includes a check valve 46 attached to a dispersement nipple 48 by any means know in the art, such as threaded connection 50.

Check valve 46 includes a check valve body 52 having a first bore 54 and a larger second bore 56 therein. A downwardly facing shoulder 58 extends between first bore 54 and second bore 56. At an opposite end of second bore 56 is an upwardly facing shoulder 60 which generally faces shoulder 58. A ball 62 is disposed in second bore 56 of check valve body 52 and is larger than first bore 54 so that the ball will seat on an edge 64 of shoulder 58. Ball 62 is biased toward shoulder 58 by a spring 66. It will be seen by those skilled in the art that fluid can pass downwardly through check valve 46, but upward flow is substantially prevented.

Dispersement nipple 48 defines a bore 68 therein which is in communication with check valve 46. Bore 68 is closed at its lower end. A plurality of nipple or injector ports 70 is defined in dispersement nipple 48. Nipple ports 70 provide communication between bore 68 and fluid cavity 42 in outer body 20 when injector portion 18 is positioned in housing portion 16. At the lower end of dispersement nipple 48 is a tapered tip or nose which helps guide the dispersement nipple as it is positioned in outer body 20.

Check valve 46 is attached to tubing 14 by an injector tubing fitting 74. Injector tubing fitting 74 is connected to check valve body 52 by any means know in the art, such as threaded connection 76. Injector tubing fitting 74 can be of any type known in the art, such as, but not limited to, a compression fitting as shown in FIG. 2B. After injector tubing fitting is connected, it will be seen by those skilled in the art that bore 68 and nipple ports 70 are in communication with tubing 14.

During assembly of enhancer 10, check valve 46 is assembled and attached to dispersement nipple 48 as previously shown and described. Before or after this, a portion of tubing 14 is inserted through housing tubing fitting 28 and opening 26 in adapter 22. Housing tubing fitting 28 is not tightened at this point. Injector tubing fitting 74 is used to connect check valve 46 to tubing 14 and tightened to make a complete injector portion 18. Injector portion 18 is inserted into outer body 20, and the outer body is connected to adapter 22 as previously shown and described. By moving tubing 14 through opening 26 in adapter 20, injector portion 18 may be positioned in the desired relative relationship within housing portion 16. Housing tubing fitting 28 is then tightened on tubing 14 to complete the assembly. It will be seen by those skilled in the art that nipple ports 70 are longitudinally spaced below body ports 44 when enhancer 10 is in an operating position in well 12. In a preferred embodiment, injector portion 18 is longitudinally positioned above end cap 36 such that scale and other deposits will settle to the bottom of fluid cavity 42 in housing portion 16 without interfering with fluid flow from nipple ports 70.

In operation, enhancer 10 is lowered into well 12 on tubing 14 to the desired depth and location in the well. Fluids are pumped down tubing 14 into injector portion 18. Check valve 46 allows fluid flow into dispersement nipple 48 and thus out nipple ports 70 into fluid cavity 42 in housing portion 16. The fluid flows upwardly through fluid cavity 42 and is discharged from enhancer 10 through body ports 44 into well 12. Because body ports 44 are longitudinally spaced above nipple ports 70, fluid cavity 42 will always have a volume of clean fluid in it from the tubing. That is, dispersement nipple 48 is at least partially submerged in this clean fluid which substantially minimizes or eliminates the build up of scale deposits in nipple ports 70. As previously mentioned, such scale deposition and the undesirable restriction in fluid flow resulting therefrom are problems with prior art enhancers which are solved by the present invention. Scale deposits may form in body ports 44, but this is not a problem because these ports are substantially larger than the nipple ports and no significant reduction in fluid flow occurs.

The creation of undesirable bubbles in dispersement nipple 48 is minimized or eliminated because it is submerged. Any bubbles will form instead in fluid cavity 42 and float to the top thereof. This is not a problem because it is virtually impossible for these bubbles to enter tubing 14.

It will be seen, therefore, that the check enhancer of the present invention is well adapted to carry out the ends and advantages mentioned, as well as those inherent therein. While a presently preferred embodiment has been shown for the purposes of this disclosure, numerous changes in the arrangement and construction of parts may be made by those skilled in the art. All such changes are encompassed within the scope and spirit of the appended claims.

What is claimed is:

1. A check enhancer apparatus for use in a well, said apparatus comprising:

a dispersement nipple defining a nipple port therein;

a check valve connected to said dispersement nipple and adapted for connection to a length of tubing such that said nipple port is in communication with said tubing when said check valve is in an open position; and an outer body disposed around said dispersement nipple and said check valve, said outer body defining a body port therein.

2. The apparatus of claim 1 wherein said body port is longitudinally spaced from said nipple port.

3. The apparatus of claim 2 wherein said body port is above said nipple port when the apparatus is positioned in the well.

4. The apparatus of claim 2 wherein:

said nipple port is one of a plurality of nipple ports defined in said dispersement nipple;

said body port is one of a plurality of body ports defined in said outer body; and all of said body ports are longitudinally spaced from all of said nipple ports.

5. The apparatus of claim 1 wherein said check valve is attached to the tubing by a tubing fitting.

6. The apparatus of claim 1 wherein said check valve is a ball check valve.

7. The apparatus of claim 1 wherein said check valve is a poppet-type valve.

8. The apparatus of claim 1 further comprising an adapter connected to said outer body and adapted for connection to the length of tubing.

9. The apparatus of claim 8 wherein the tubing is slidably disposed through said adapter such that said dispersement nipple and said check valve may be longitudinally moved in said outer body.

10. The apparatus of claim 8 wherein said adapter is attached to the tubing by a tubing fitting.

11. The apparatus of claim 10 wherein said check valve is attached to the tubing by another tubing fitting.

12. A check enhancer apparatus comprising:

an outer body defining a fluid cavity therein and a body port in communication with said fluid cavity;

a bonnet connected to said outer body and adapted for connection to a length of tubing, said bonnet defining an opening therethrough for receiving a portion of the tubing therethrough such that the tubing may extend into said fluid cavity;

a check valve disposed in said fluid cavity and adapted for connection to the tubing extending into said fluid cavity; and a dispersement nipple connected to said outer body and defining a nipple port therein in communication with said check valve and spaced from said body port such that fluid flowing through said tubing and check valve is discharged out of said nipple port and at least partially fills said fluid cavity before being discharged from said outer body through said body port.

13. The apparatus of claim 12 wherein said opening in said bonnet is sized to allow the tubing to be slidably disposed therethrough.

14. The apparatus of claim 12 wherein:

said nipple port is one of a plurality of nipple ports defined in said dispersement nipple;

said body port is one of a plurality of body ports defined in said outer body; and all of said body ports are longitudinally spaced from all of said nipple ports.

15. The apparatus of claim 12 wherein said check valve allows fluid flow from the tubing to said dispersement nipple and substantially prevents fluid flow from said dispersement nipple to the tubing.

16. The apparatus of claim 15 wherein said check valve is a ball check valve.

17. The apparatus of claim 15 wherein said check valve is a poppet-type valve.

18. The apparatus of claim 12 wherein said body port is above said nipple port when the apparatus is positioned in the well.

19. A check enhancer apparatus for use in a well and comprising:

a housing portion defining a fluid cavity therein and a housing port in communication with said fluid cavity;

a length of tubing connected to said housing portion such that a portion of said tubing extends into said fluid cavity; and an injector portion disposed in said fluid cavity and connected to said portion of said tubing, said injector portion defining an injector port therein in communication with said tubing and said fluid cavity, said injector port being longitudinally spaced from said housing port.

20. The apparatus of claim 19 wherein said housing portion comprises:

an outer body in which said housing port is disposed; and an adapter connected to said outer body and said tubing.

21. The apparatus of claim 20 wherein said adapter defines an opening through which said tubing is slidably disposed.

22. The apparatus of claim 19 wherein said injector portion comprises:

a dispersement nipple in which said injector port is disposed; and a check valve connected to said dispersement nipple and said portion of said tubing.

23. The apparatus of claim 22 wherein said check valve allows fluid flow from the tubing to said dispersement nipple and substantially prevents fluid flow from said dispersement nipple to said tubing.

24. The apparatus of claim 22 wherein said check valve is a ball check valve.

25. The apparatus of claim 23 wherein said check valve is a poppet-type valve.

26. The apparatus of claim 19 wherein said housing port is above said injector port when the apparatus in disposed in the well, such that fluid flowing out of said injector port at least partially fills said fluid cavity before flowing out of said housing port.

27. The apparatus of claim 19 wherein:

said injector port is one of a plurality of injector ports;

said housing port is one of a plurality of housing ports; and all of said housing ports are longitudinally spaced from all of said injector ports.

* * * * *